United States Patent [19]

Nakajima et al.

[11] Patent Number: 4,917,578

[45] Date of Patent: Apr. 17, 1990

[54] VARIABLE CAPACITY COMPRESSOR

[75] Inventors: Nobuyuki Nakajima; Toshio Yamaguchi, both of Konan, Japan

[73] Assignee: Diesel Kiki Co., Ltd., Tokyo, Japan

[21] Appl. No.: 325,922

[22] Filed: Mar. 20, 1989

[30] Foreign Application Priority Data

Apr. 15, 1988 [JP] Japan ..... 63-92889

[51] Int. Cl.[4] ..... F04B 49/00; F04C 29/08

[52] U.S. Cl. ..... 417/295; 417/310

[58] Field of Search ..... 417/295, 310

[56] References Cited

U.S. PATENT DOCUMENTS 4,744,732 5/1988 Nakajima et al. ..... 417/310

4,813,854 3/1989 Nakajima ..... 417/295

*Primary Examiner*—Leonard E. Smith

*Attorney, Agent, or Firm*—Charles S. McGuire

[57] ABSTRACT

A variable capacity compressor has a control element rotatably arranged within a cylinder, which has two pressure-receiving portions slidably received, respectively, in first and second pressure working chambers formed in the cylinder such that the first pressure working chamber is divided into a first lower-pressure chamber and a first higher-pressure chamber, and the second pressure working chamber into a second lower-pressure chamber and a second higher-pressure chamber. The first and second lower-pressure chambers are supplied with low pressure. A first passage extends between one of the first and second higher-pressure chambers and a compression space for supplying the former with discharge pressure from the latter. A second passage communicates between the first and second higher-pressure chambers. A control valve device is operable in response to suction pressure in the compressor for controlling pressure within the first and second higher-pressure chambers. The control element is rotated in response to change in the difference between pressure within the first and second lower pressure chambers and pressure within the first and second higher-pressure chambers for varying the capacity of the compressor. The compressor includes a third passage extending between the above one of the first and second higher-pressure chambers and a zone under low pressure within the compressor for leaking pressure from the former into the latter. The control valve device is disposed to open and close the third passage in response to the suction pressure.

4 Claims, 5 Drawing Sheets

VARIABLE CAPACITY COMPRESSOR

BACKGROUND OF THE INVENTION

This invention relates to variable capacity compressors which compress refrigerant gas primarily adapted for use in air conditioning systems for automotive vehicles, and more particularly to a compressor of this kind which has a control element rotatable in opposite directions in response to the difference between high pressure and low pressure for varying the compression starting timing of the compressor and hence the capacity thereof.

A variable capacity compressor of this kind has been proposed, e.g., by U.S. Ser. No. 196,329, now U.S. Pat. No. 4,813,854, assigned to the present assignee, in which, as shown in FIG. 1, a pair of pressure-working chambers $B_1$, $B_2$ are provided at diametrically opposite locations, and a control element A has a pair of integral pressure-receiving protuberances $A_1$, $A_1$ slidably received in the pressure-working chambers $B_1$, $B_2$ and dividing them into lower-pressure chambers $B_{1L}$, $B_{2L}$ and higher-pressure chambers $B_{1H}$, $B_{2H}$. The lower-pressure chambers $B_{1L}$, $B_{2L}$ are supplied with suction pressure Ps as low pressure, whereas the higher-pressure chambers $B_{1H}$, $B_{2H}$ are supplied with discharge pressure Pd as high pressure for creating therein control pressure Pc. A control valve device C is operable in response to the suction pressure Ps within a suction chamber I for controlling the control pressure Pc.

In the proposed compressor, when the suction pressure Ps within the suction chamber I is below a predetermined value, the control valve device C is open to leak the control pressure Pc within the higher-pressure chambers $B_{1H}$, $B_{2H}$ into the suction chamber I, whereas when the suction pressure Ps is above the predetermined value, it is closed to keep the control pressure Pc at a high level, whereby the control element A is rotated in response to the difference between the sum of the suction pressure Ps and the urging force of a torsional coiled spring D which urges the control element A toward a partial capacity position, and the control pressure Pc, between two opposite extreme positions, i.e., a full capacity position shown in FIG. 1 and the partial capacity position to be assumed by the control element A when rotated in a clockwise direction as viewed in FIG. 1, thereby varying the timing of commencement of the compression stroke and hence the delivery quantity or capacity of the compressor.

However, according to the proposed compressor, the discharge pressure Pd is introduced through a restriction passage F into one higher-pressure chamber $B_{1H}$, wherefrom it is supplied to the other higher-pressure chamber $B_{2H}$ via a passage E for creating the control pressure Pc within the both higher-pressure chambers $B_{1H}$, $B_{2H}$. However, the control pressure Pc within the one higher-pressure chamber $B_{1H}$ is created by the discharge pressure Pd directly supplied to the chamber $B_{1H}$ through the restriction passage F and thus behaves as dynamic pressure. As a result, when the suction pressure Ps within the suction chamber I is below the predetermined value and the control valve device C is open, the control pressure Pc within the one higher-pressure chamber $B_{1H}$ is apt to be throttled by the passage E while leaking therethrough. Consequently, the control pressure Pc within the one higher-pressure chamber $B_{1H}$ is not promptly lowered and accordingly the control element A is not smoothly rotated from the full capacity position to the partial capacity position, resulting in poor controllability of the capacity of the compressor.

Further, even when the control pressure Pc within the higher-pressure chambers $B_{1H}$, $B_{2H}$ decreases to its minimum level, it is still too high with respect to the suction pressure Ps, i.e., there is too large a difference between the control pressure Pc and the suction pressure Ps to obtain a sufficiently wide variable range of the capacity of the compressor.

If the setting load of the torsional coiled spring D is increased in order to enable the control element A to promptly rotate toward the partial capacity position, the urging force of the spring D becomes so large that the control element A does not promptly rotate toward the full capacity position. Besides, the increased setting load of the spring D can lower the safety factor thereof.

SUMMARY OF THE INVENTION

It is the object of the invention to provide a variable capacity compressor which is capable of decreasing the control pressure for controlling the control element to such a level that the difference between the control pressure and the suction pressure is sufficiently small, thereby improving the controllability of the control element and hence the capacity of the compressor.

It is a further object of the invention to provide a variable capacity compressor which has a sufficiently wide variable range of the capacity of the compressor.

To attain the above objects, the present invention provides a variable capacity compressor having a cylinder, two compression spaces defined within the cylinder, a control element rotatably arranged within the cylinder and having two pressure-receiving portions formed thereon at substantially diametrically opposite locations, first and second pressure working chambers formed in the cylinder, the two pressure-receiving portions being slidably received, respectively, in the first and second pressure working chambers such that the first pressure working chamber is divided into a first lower-pressure chamber and a first higher-pressure chamber, and the second pressure working chamber is divided into a second lower-pressure chamber and a second higher-pressure chamber, the first and second lower-pressure chambers being supplied with low pressure, first passage means extending between one of the first and second higher-pressure chambers and at least one of the compression spaces for supplying the former with discharge pressure from the latter, second passage means communicating between the first and second higher-pressure chambers, control valve means operable in response to suction pressure in the compressor for controlling pressure within the first and second higher-pressure chambers, wherein the control element is rotated in opposite directions in response to change in the difference between pressure within the first and second lower-pressure chambers and pressure within the first and second higher-pressure chambers for varying the capacity of the compressor.

The variable capacity compressor according to the invention is characterized by an improvement including third passage means extending between the one of the first and second higher-pressure chambers and a zone under low pressure within the compressor for leaking pressure from the former into the latter, and wherein the control valve means is disposed to open and close the third passage means in response to the suction pressure.

Preferably, the other of the first and second higher-pressure chambers may communicate solely with the one of the first and second higher-pressure chambers through the second passage means.

More preferably, the zone under low pressure may be a suction chamber.

The above and other objects, features and advantages of the invention will become more apparent from the ensuing detailed description taken in conjunction with the accompanying drawings.

DETAILED DESCRIPTION

The invention will now be described in detail with reference to the drawings showing an embodiment thereof.

FIGS. 2 through 5 show a variable capacity vane compressor according to an embodiment of the invention.

Figure 1:
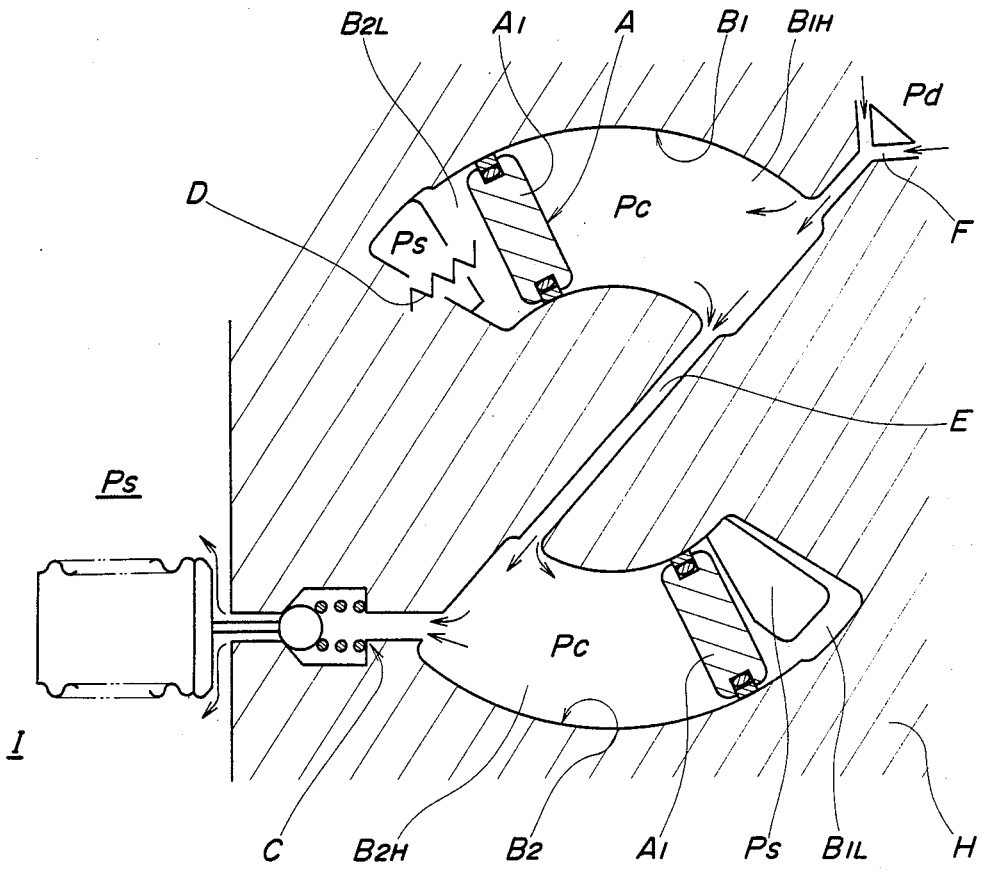
FIG. 1 PRIOR ART
FIG. 1 is a view useful for explaining the operation of a capacity control section of a conventional variable capacity compressor.
Figure 2:
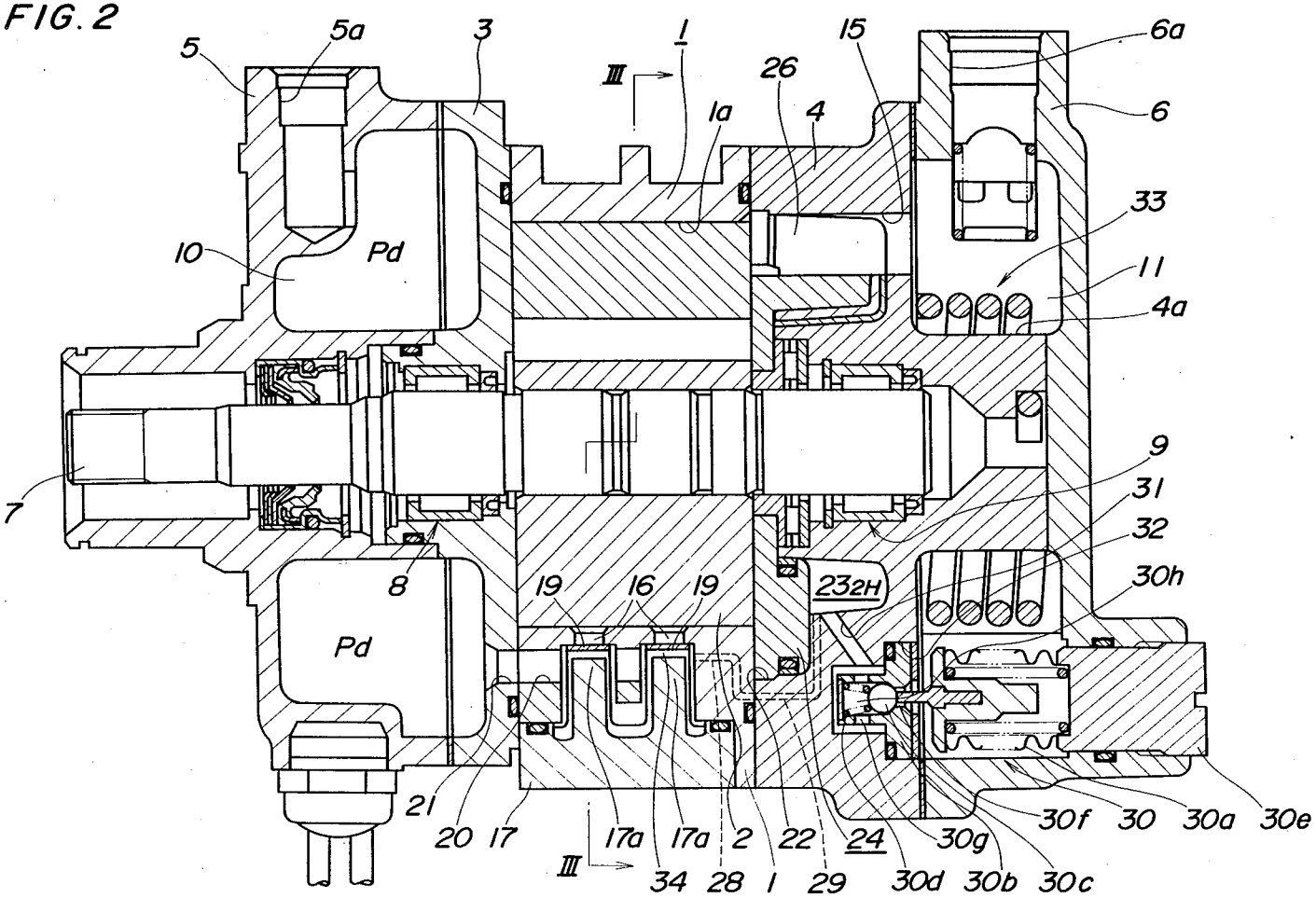
FIG. 2 is a longitudinal sectional view of a variable capacity compressor according to the invention.
Figure 3:
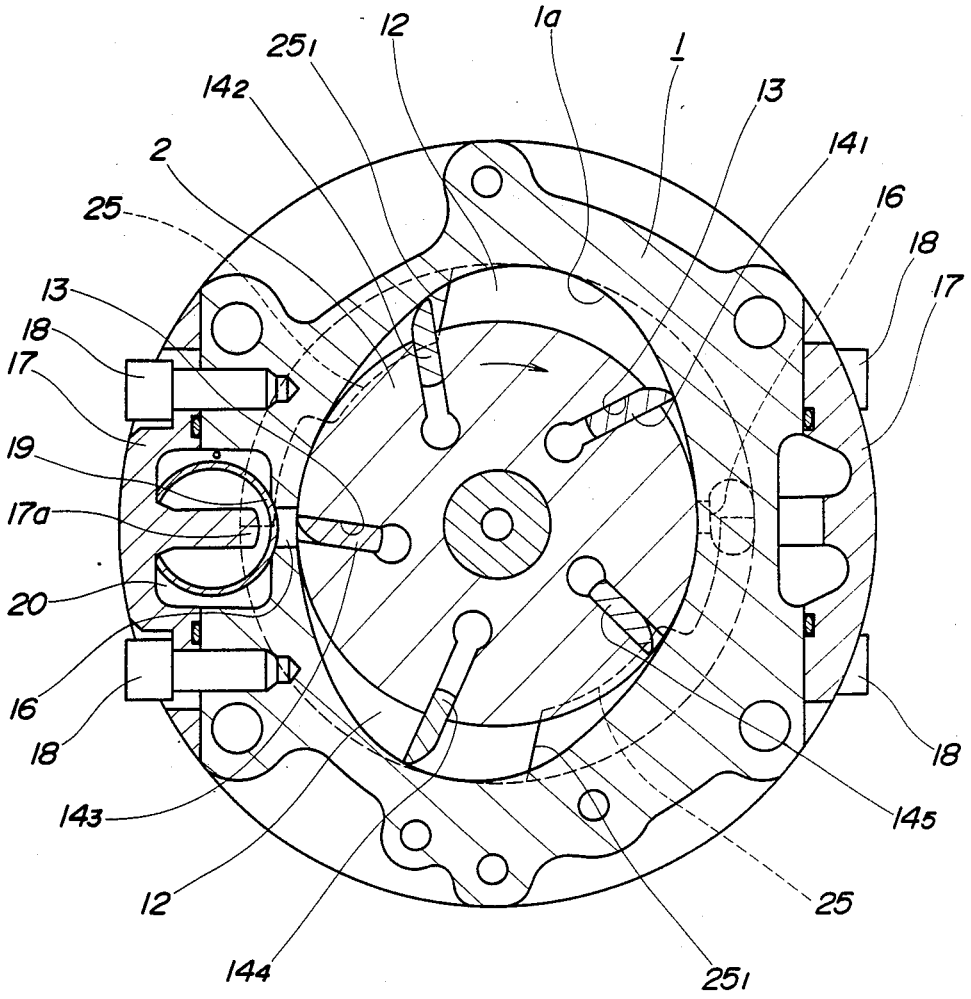
FIG. 3 is a transverse sectional view taken along line III—III in FIG. 2, in which the control element is in a full capacity position.

As shown in FIGS. 2 and 3, the variable capacity vane compressor is composed mainly of a cylinder formed by a cam ring 1 having an inner peripheral camming surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As shown in FIG. 3, a pair of compression spaces 12, 12 are defined at diametrically opposite locations between the inner peripheral camming surface 1*a* of the cam ring 1, an outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane $14_1$–$14_5$ is radially slidably fitted.

Refrigerant inlet ports 15, 15 are formed in the rear side block 4 at diametrically opposite locations, though only one of which is shown in FIG. 3. These refrigerant inlet ports 15, 15 are located at such locations that they become closed when a compression chamber defined between successive two vanes $14_1$–$14_5$ assumes the maximum volume. These refrigerant inlet ports 15, 15 axially extend through the rear side block 4 and through which the suction chamber 11 and the compression spaces 12, 12 are communicated with each other.

A pair of refrigerant outlet ports 16, 16, each port having two openings, are formed through opposite lateral side walls of the cam ring 1 at diametrically opposite locations, as shown in FIGS. 2 and 3, though only one of which is shown in FIG. 3. The cam ring 1 has opposite lateral side walls thereof provided with respective discharge valve covers 17, 17, each formed integrally with a valve stopper 17*a*, and fixed to the cam ring 1 by fixing bolts 18. A discharge valve 19 is arranged in a valve chamber 34 defined between the outer wall of the cam ring 1 and each valve cover 17. Each valve cover 17, 17 has the discharge valve 19 supported thereby so that the valve 19 is deformable between an outer end of an associated opening of the refrigerant outlet port 16 and the valve stopper 17*a*. Accordingly, the discharge valve 19 opens in response to discharge pressure Pd to thereby open the refrigerant outlet port 16. Further formed in the cam ring 1 at diametrical opposite locations are a pair of passages 20, 20 which communicate, respectively, with the refrigerant outlet ports 16 when the associated discharge valve 19 opens. A pair of passages 21, 21 are also formed in the front side block 3, which communicate, respectively, with the passages 20, 20.

With such arrangement, when the discharge valves 19 open to thereby open the refrigerant outlet ports 16, a compressed refrigerant gas in the associated compression space 12 is discharged from the discharge port 5*a* via the refrigerant discharge outlet port 16, the passages 20, 21 and the discharge pressure chamber 10, in the mentioned order.

As shown in FIGS. 2 and 3, the rear side block 4 has an end face facing the rotor 2, in which is formed an annular recess 22. A pair of pressure working chambers $23_1$, $23_2$ are formed in a bottom of the annular recess 25 at diametrically opposite locations.

A control element 24, which is in the form of an annulus, is received in the annular recess 22 for rotation about its own axis in opposite circumferential directions. The control element 24 has its outer peripheral edge formed with two diametrically opposite arcuate cut-out portions 25, 25, as shown in FIG. 3, and its one side surface formed integrally with a pair of diametrically opposite pressure-receiving protuberances 26, 26 axially projected therefrom and acting as pressure-receiving elements. The protuberances 26, 26 are slidably received, respectively, within the pressure working chambers $23_1$, $23_2$.

Figure 5:
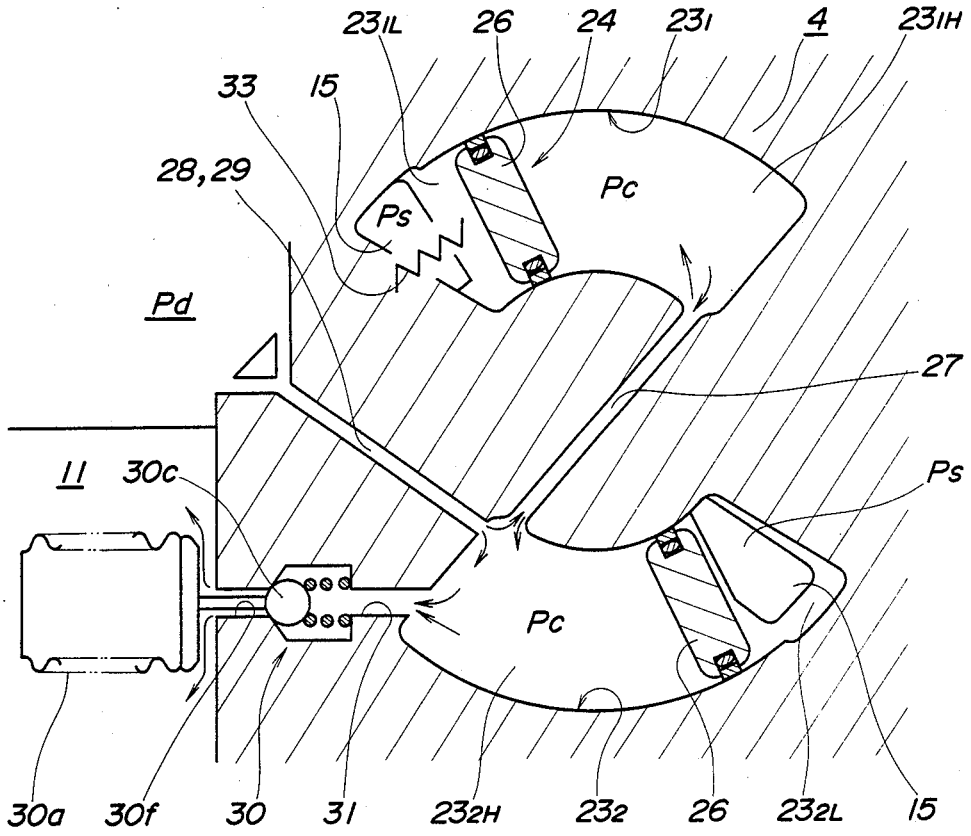
FIG. 5 is a view useful for explaining the operation of a capacity control section of the compressor of FIG. 2.

As shown in FIG. 5, the interior of each of the pressure working chambers 26, 26 is divided into a lower-pressure chamber $23_{1L}$, $23_{2L}$ and a higher-pressure chamber $23_{1H}$, $23_{2H}$ by the associated pressure-receiving protuberance 26. Each lower-pressure chamber $23_{1L}$, $23_{2L}$ communicates with the suction chamber 11 through the corresponding refrigerant inlet port 15 and is supplied with refrigerant gas having suction pressure or low pressure Ps.

On the other hand, the higher-pressure chambers $23_{1H}$, $23_{2H}$ are in communication with each other by way of a passage 27 formed in the rear side block 4 (FIG. 5). Further, the higher-pressure chamber $23_{2H}$ is in communication with the valve chamber 34 via restriction passages 28 and 29 formed, respectively, in the cam ring 1 and the rear side block 4.

With such arrangement, high pressure or discharge pressure Pd within the valve chamber 34 is supplied via the restriction passages 28, 29 to the higher-pressure chamber $23_{2H}$, wherefrom it is supplied to the higher-pressure chamber $23_{1H}$ via the communication passage 27, thereby creating control pressure Pc within the both higher-pressure chambers $23_{1H}$, $23_{2H}$.

A control valve device 30 is arranged between the higher-pressure chamber $23_{2H}$ and the suction chamber 11. The control valve device 30 is operable in response to the suction pressure Ps within the suction chamber 11, and comprises a flexible bellows **30*a* as a pressure-responsive member, a valve casing 30*b*, a ball valve body 30*c*, a coiled spring 30*d* urging the ball valve body 30*c* in the valve closing direction. The bellows 30*a* is disposed within the suction chamber 11 for expansion and contraction in response to the suction pressure Ps. The valve casing 30*b* is fitted in a valve-receiving space 32 formed in the rear side block 4 in communication with a passage 31 leading to the higher-pressure chamber $23_{2H}$. When the suction pressure Ps within the suction chamber 11 is above a predetermined value set by an adjusting member 30*e*, the bellows 30*a* is in a contracted state to bias the ball valve body 30*c* in a position of closing a central hole 30*f* formed through the valve casing 30*b*. On the other hand, when the suction pressure Ps is below the predetermined value, the bellows 30*a* is in an expanded state to bias the ball valve body 30*c* in a position of opening the central hole 30*f*, whereby the higher-pressure chamber $23_{2H}$ is brought into communication with the suction chamber 11 via the passage 31, the valve-receiving space 32, a pair of radial holes 30*g* formed in the valve casing 30*b*, a chamber 30*h* defined within the valve casing 30*b*, and the central hole 30*f***.

As shown in FIGS. 2 and 5, the control element 24 is urged in a clockwise direction as viewed in FIG. 5 by a torsion coiled spring 33, which is fitted around a hub **4*a* of the rear side block 4 axially extending into the suction chamber 11 with its one end engaged with one side surface of the control element 24 remote from the rotor 2 and its other end engaged with an end face of the hub 4*a***.

The control element 24 is rotatable in opposite directions in response to the difference between the sum of the suction pressure Ps within the lower-pressure chambers $23_{1L}$, $23_{2L}$ and the urging force of the coiled spring 33, and the control pressure Pc within the both higher-pressure chambers $23_{1H}$, $23_{2H}$. Specifically, the control valve device 30 controls the control pressure Pc within the higher-pressure chambers $23_{1H}$, $23_{2H}$ so as to bring the suction pressure Ps to the predetermined value, so that the control element 24 rotates in opposite directions between two extreme positions, i.e., a full capacity position shown in FIG. 3 for obtaining the maximum delivery quantity or capacity of the compressor, and a partial capacity position shown in FIG. 4 for obtaining the minimum delivery quantity or capacity.

The operation of the compressor according to the invention constructed as above will now be explained.

When the compressor is operated at a low rotational speed, the suction pressure Ps within the suction chamber 11 is above the predetermined value and accordingly the bellows **30*a* of the control valve device 30 contracts to bias the ball valve body 30*c* in a position of closing the central hole 30*f* of the valve casing 30*b*, as shown in FIGS. 2 and 5. On this occasion, the discharge pressure Pd within the valve chamber 34 is introduced through the restriction passages 28, 29 into the higher-pressure chamber $23_{2H}$, wherefrom it is further supplied through the passage 27 to the other higher-pressure chamber $23_{1H}$, thereby creating control pressure Pc having a high pressure level within the both higher-pressure chambers $23_{1H}$, $23_{2H}$. As a result, the control pressure Pc within the higher-pressure chambers $23_{1H}$, $23_{2H}$ overcomes the sum of the suction pressure Ps within the lower-pressure chambers $23_{1L}$, $23_{2L}$ and the urging force of the coiled spring 33 to thereby cause the control element 24 to rotate in a direction toward the full capacity position shown in FIGS. 3 and 5, i.e., in a counterclockwise direction as viewed in FIG. 3. In the full capacity position of the control element 24, the respective forward end edges $25_1$, $25_1$ of the cutout portions 25, 25 with respect to the rotation of the rotor 2 are in the most rearward position, i.e., in the extreme counterclockwise position as viewed in FIG. 3. Consequently, compression stroke in each compression space 12** commences at the most advanced timing so that the amount of refrigerant gas trapped between two adjacent vanes, e.g., vanes $14_1$ and $14_2$, increases to the maximum to obtain the maximum delivery quantity or capacity of the compressor.

When the compressor is brought into a high speed operation, the suction pressure Ps within the suction chamber 11 decreases below the predetermined value and accordingly the bellows **30*a* of the control valve device 30 expands to bias the ball valve body 30*c* into a position of opening the central hole 30*f* of the valve casing 30*b*, so that the control pressure Pc within the higher-pressure chambers $23_{1H}$, $23_{2H}$ leaks into the suction chamber 11 through the passage 31, the valve-receiving space 32, the radial bores 30*g*, the valve chamber 30*h*, and the central hole 30*h*, thereby lowering in pressure level. On this occasion, although the higher-pressure chamber $23_{2H}$ is directly supplied with discharge pressure Pd which is dynamic pressure, through the restriction passages 28, 29, the control pressure Pc leaks from the chamber $23_{2H}$ into the suction chamber 11 through the open control valve device 30, without being throttled. Consequently, the pressure within the higher-pressure chamber $23_{2H}$ lowers to a sufficiently low level. On the other hand, the control pressure Pc within the other higher-pressure chamber $23_{1H}$ has been supplied from the higher-pressure chamber $23_{2H}$ through the passage 27 alone, and is therefore in a static state. Therefore, the control pressure Pc within the higher-pressure chamber $23_{1H}$ smoothly flows through the passage 27** into the higher-pressure chamber $23_{2H}$ without being throttled. Thus, the control pressure Pc within the both higher-pressure chambers $23_{1H}$, $23_{2H}$ promptly lowers to such a sufficiently low level that the difference between the control pressure Pc and the suction pressure Ps sufficiently small. Specifically, supposing that the suction pressure Ps is approximately 2 $kg/cm^2$, for example, the control pressure Pc could not be decreased below approximately 3 $kg/cm^2$ in the conventional compressor. However, in the compressor according to the invention, the control pressure Pc can be decreased as low as approximately 2.5 kg/cm$^2$, which is very close to the suction pressure Ps.

Figure 4:
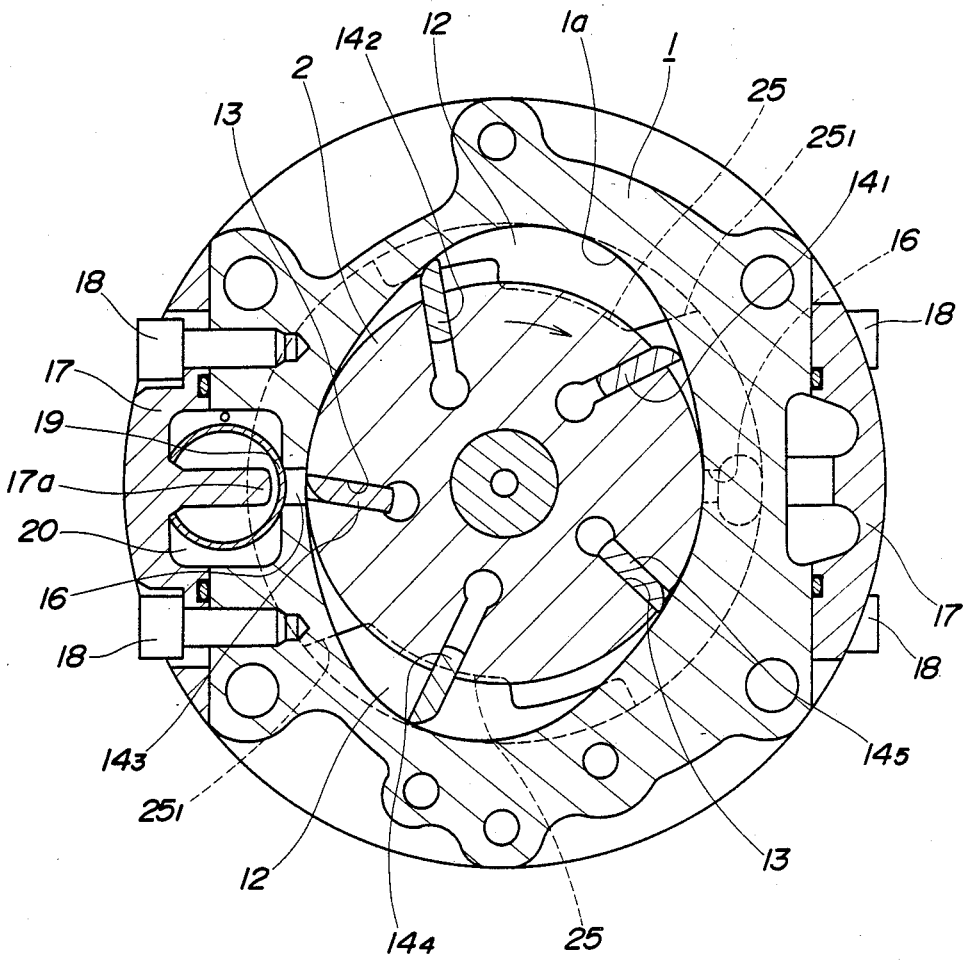
FIG. 4 is a view similar to FIG. 3, in which the control element is in a partial capacity position.

When the control pressure Pc within the higher-pressure chambers $23_{1H}$, $23_{2H}$ has thus been decreased to the minimum level and surpassed by the sum of the suction pressure Ps within the lower-pressure chambers $23_{1L}$, $23_{2L}$ and the urging force of the coiled spring 33, the control element 24 is promptly rotated in the clockwise direction as viewed in FIG. 3 from the full capacity position shown in the same figure to the partial capacity position shown in FIG. 4. In the partial capacity position of the control element 24, the respective forward end edges $25_1$, $25_1$ of the cutout portions 25, 25 with respect to the rotation of the rotor 2 are in the most forward position, i.e., in the extreme clockwise position as viewed in FIG. 4, wherein compression stroke in each compression space 12 commences at the most retarded timing so that the amount of refrigerant gas trapped between two adjacent vanes, e.g., vanes $14_1$ and $14_2$ is decreased to the minimum to obtain the minimum delivery quantity or capacity of compressor.

Therefore, according to the invention, the control pressure Pc can be varied over a widened range under the control of the valve control device 30, and hence the capacity of the compressor can be controlled over a wider range.

What is claimed is:

1. In a variable capacity compressor having a cylinder, two compression spaces defined within the cylinder, a control element rotatably arranged within said cylinder and having two pressure-receiving portions formed thereon at substantially diametrically opposite locations, first and second pressure working chambers formed in said cylinder, said two pressure-receiving portions being slidably received, respectively, in said first and second pressure working chambers such that said first pressure working chamber is divided into a first lower-pressure chamber and a first higher-pressure chamber, and said second pressure working chamber is divided into a second lower-pressure chamber and a second higher-pressure chamber, said first and second lower-pressure chambers being supplied with low pressure, first passage means (27) communicating between said first and second higher-pressure chambers, second passage means (31, 30*f*) extending between one of said first and second higher-pressure chambers and a low-pressure side, control valve means operable in response to suction pressure in said compressor for opening and closing said second passage means to control pressure within said first and second higher-pressure chambers, wherein said control element is rotated in opposite directions in response to change in the difference between pressure within said first and second lower-pressure chambers and pressure within said first and second higher-pressure chambers for varying the capacity of said compressor, the improvement comprising third passage means (28,29) opening into said one of said first second higher-pressure chambers and communicating said one of said first and second higher-pressure chambers with at least one of said compression spaces for supplying the former with discharge pressure from the latter.

2. In a variable capacity compressor having a cylinder, two compression spaces defined within the cylinder, a control element rotatably arranged within said cylinder and having two pressure-receiving portions formed thereon at substantially diametrically opposite locations, first and second pressure working chambers formed in said cylinder, said two pressure-receiving portions being slidably received, respectively, in said first and second pressure working chambers such that said first pressure working chamber is divided into a first lower-pressure chamber and a first higher-pressure chamber, and said second pressure working chamber is divided into a second lower-pressure chamber and a second higher-pressure chamber, said first and second lower-pressure chambers being supplied with low pressure, first passage means (27) communicating between said first and second higher-pressure chambers, second passage means (31, 30*f*) extending between one of said first and second higher-pressure chambers and a low-pressure side, control valve means operable in response to suction pressure in said compressor for opening and closing said second passage means to control pressure within said first and second higher-pressure chambers, wherein said control element is rotated in opposite directions in response to change in the difference between pressure within said first and second lower-pressure chambers and pressure within said first and second higher-pressure chambers for varying the capacity of said compressor, the improvement comprising third passage means (28, 29) opening into said one of said first second higher-pressure chambers and communicating said one of said first and second higher-pressure chambers with at least one of said compression spaces for supplying the former with discharge pressure from the latter and the other of said first and second higher-pressure chambers communicating solely with said one of said first and second higher-pressure chambers through said second passage means.

3. In a variable capacity compressor having a cylinder, two compression spaces defined within the cylinder, a control element rotatably arranged within said cylinder and having two pressure-receiving portions formed thereon at substantially diametrically opposite locations, first and second pressure working chambers formed in said cylinder, said two pressure-receiving portions being slidably received, respectively, in said first and second pressure working chambers such that said first pressure working chamber is divided into a first lower-pressure chamber and a first higher-pressure chamber, and said second pressure working chamber is divided into a second lower-pressure chamber and a second higher-pressure chamber, said first and second lower-pressure chambers being supplied with low pressure, first passage means extending between one of said first and second higher-pressure chambers and at least one of said compression spaces for supplying the former with discharge pressure from the latter, second passage means communicating between said first and second higher-pressure chambers, control valve means operable in response to suction pressure within said first and second higher-pressure chambers, wherein said control element is rotated in opposite directions in response to change in the difference between pressure within said first and second lower-pressure chambers and pressure within said first and second higher-pressure chambers for varying the capacity of said compressor, the improvement including third passage means extending between said one of said first and second higher-pressure chambers and a zone under low pressure within said compressor for leaking pressure from the former into the latter, said control valve means being disposed to open and close said third passage means in response to said suction pressure and the other of said first and second higher-pressure chambers communicating solely with said one of said first and second higher-pressure chambers through said second passage means.

4. A variable capacity compressor as claimed in claim 1 or 2, wherein said zone under low pressure is a suction chamber.

* * * * *

UNITED STATES PATENT AND TRADEMARK OFFICE

CERTIFICATE OF CORRECTION

PATENT NO. : 4,917,578

DATED : April 17, 1990

INVENTOR(S) : Nakajima, et al

It is certified that error appears in the above-identified patent and that said Letters Patent is hereby corrected as shown below:

In column 7, line 54, after "first" add --and--.

In column 8, line 19, after "first" add --and--.

Signed and Sealed this

Seventeenth Day of September, 1991

*Attest:*

HARRY F. MANBECK, JR.

*Attesting Officer*

*Commissioner of Patents and Trademarks*